US005100862A

United States Patent [19]

Harrison et al.

[11] Patent Number: 5,100,862

[45] Date of Patent: Mar. 31, 1992

[54] MICROVOIDED SUPPORTS FOR RECEIVING ELEMENT USED IN THERMAL DYE TRANSFER

[75] Inventors: Daniel J. Harrison, Rochester; Jong S. Lee, Pittsford; Larry K. Maier, Rochester, all of N.Y.

[73] Assignee: Eastman Kodak Company, Rochester, N.Y.

[21] Appl. No.: 734,023

[22] Filed: Jul. 22, 1991

Related U.S. Application Data

[63] Continuation of Ser. No. 516,616, Apr. 30, 1990, abandoned.

[51] Int. Cl.[5] ..... B41M 5/035; B41M 5/26

[52] U.S. Cl. ..... 503/227; 428/195; 428/304.4; 428/327; 428/403; 428/480; 428/913; 428/914

[58] Field of Search ..... 8/471; 428/195, 304.4, 428/327, 403, 480, 913, 914; 503/227

[56] References Cited

U.S. PATENT DOCUMENTS

| | | | |
|---|---|---|---|
| 4,320,207 | 3/1982 | Watanabe et al. | 521/54 |
| 4,698,372 | 10/1987 | Moss | 521/145 |
| 4,778,782 | 10/1988 | Ito et al. | 503/227 |
| 4,897,377 | 1/1990 | Marbrow | 503/227 |
| 4,914,078 | 4/1990 | Hann et al. | 503/227 |
| 4,971,950 | 11/1990 | Kato et al. | 503/227 |
| 4,994,312 | 2/1991 | Maier et al. | 428/36.5 |

FOREIGN PATENT DOCUMENTS

| | | | |
|---|---|---|---|
| 0322771 | 5/1989 | European Pat. Off. | 503/227 |
| 0387718 | 9/1990 | European Pat. Off. | 428/212 |
| 1-304152 | 12/1989 | Japan | 503/327 |
| 1-306459 | 12/1989 | Japan | 503/227 |
| 2-8089 | 1/1990 | Japan | 503/227 |
| 2-11640 | 1/1990 | Japan | 428/331 |
| 2-47092 | 2/1990 | Japan | 503/227 |
| 2-225086 | 9/1990 | Japan | 503/227 |
| 2-227437 | 9/1990 | Japan | 428/513 |
| 2-243397 | 9/1990 | Japan | 503/227 |

*Primary Examiner*—Bruce H. Hess
*Attorney, Agent, or Firm*—Andrew J. Anderson

[57] ABSTRACT

A dye-receiving element for thermal dye transfer including a support having thereon a polymeric dye image-receiving layer wherein the support includes a continuous oriented polymer matrix having dispersed therein microbeads of a cross-linked polymer coated with a slip agent and which are at least partially bordered by void space.

17 Claims, No Drawings

MICROVOIDED SUPPORTS FOR RECEIVING ELEMENT USED IN THERMAL DYE TRANSFER

This is a continuation of application Ser. No. 516,616, filed Apr. 30, 1990, now abandoned.

CROSS REFERENCE TO RELATED APPLICATIONS

Reference is made to co-pending, commonly assigned U.S. Ser. No. 457,894, filed Dec. 27, 1989, entitled "Shaped Articles From Orientable Polymers and Polymer Microbeads," the disclosure of which is incorporated by reference, now U.S. Pat. No. 4,994,312.

TECHNICAL FIELD

This invention relates to dye-receiving elements used in thermal dye transfer, and more particularly to receiving elements having microvoided supports.

BACKGROUND

In recent years, thermal transfer systems have been developed to obtain prints from pictures which have been generated electronically from a color video camera. According to one way of obtaining such prints, an electronic picture is first subjected to color separation by color filters. The respective color-separated images are then converted into electrical signals. These signals are then operated on to produce cyan, magenta and yellow electrical signals. These signals are then transmitted to a thermal printer. To obtain the print, a cyan, magenta or yellow dye-donor element is placed face-to-face with a dye-receiving element. The two are then inserted between a thermal printing head and a platen roller. A line-type thermal printing head is used to apply heat from the back of the dye-donor sheet. The thermal printing head has many heating elements and is heated up sequentially in response to the cyan, magenta and yellow signals. The process is then repeated for the other two colors. A color hard copy is thus obtained which corresponds to the original picture viewed on a screen. Further details of this process and an apparatus for carrying it out are contained in U.S. Pat. No. 4,621,271 by Brownstein entitled "Apparatus and Method For Controlling A Thermal Printer Apparatus," issued Nov. 4, 1986, the disclosure of which is hereby incorporated by reference.

Dye-receiving elements used in thermal dye transfer generally comprise a polymeric dye image-receiving layer coated on a support. Supports are required to have, among other properties, adequate strength, dimensional stability, and heat resistance. For reflective viewing, supports are also desired to be as white as possible. Cellulose paper, synthetic paper, and plastic films have all been proposed for use as dye-receiving element supports in efforts to meet these requirements. Recently, microvoided films formed by stretching an orientable polymer containing an incompatible organic or inorganic material have been suggested for use in dye-receiving elements. U.S. Pat. No. 4,778,782 of Ito et al., for example, discloses supports comprising a microvoided film obtained by stretching a translucent plastic film containing fine fillers such as clay or talc. By this stretching, bonds between the polymers and fillers in the film are destroyed, whereby microvoids are considered to be formed in the film. The microvoids lower the density of the film and also make it appear white and opaque. European Patent Application 0 322 771 discloses dye-receiving element supports comprising a polyester film containing polypropylene and minute closed cells within the film formed upon stretching.

A problem exists with the microvoided supports discussed above, however, in that it is difficult to manufacture films with a high degree of microvoiding. A high degree of microvoiding is desirable as this increases the heat insulating property of the support, and thereby the thermal efficiency of the dye transfer. EP 0 322 771 Comparative Example 4, for example, shows that a high degree of microvoiding in polyester/polypropylene stretched films, as evidenced by a relatively low specific gravity, results in poor mechanical strength and frequent breakage of the film during stretching. The lowest apparent specific gravity for an operable film in EP 0 322 771 is 0.71 (Example 2).

It would be desirable to provide a dye image-receiving element for thermal dye transfer with a manufacturable microvoided support which would provide superior thermal efficiency.

SUMMARY OF THE INVENTION

These and other objects of the invention are achieved in accordance with this invention which comprises a dye-receiving element for thermal dye transfer comprising a support having thereon a polymeric dye image-receiving layer wherein the support comprises a continuous oriented polymer matrix having dispersed therein microbeads of a cross-linked polymer coated with a slip agent and which are at least partially bordered by void space.

The combination of cross-linked microbeads and a slip agent coating allows supports with a relatively high degree of microvoiding to be manufactured. The cross-linking of the microbead polymer provides resiliency and elasticity while the slip agent permits easier sliding between the microbeads and the matrix polymer to result in more effective microvoiding. This allows films with a higher void percentage and thereby greater insulating effect to be manufactured. Such films have been found to be particularly advantageous for thermal dye transfer applications as the greater insulating effect results in greater dye transfer efficiency.

DETAILED DESCRIPTION

The receiving elements of the invention use supports comprising a continuous thermoplastic polymer phase having dispersed therein microbeads of polymer which are at least partially bordered by voids. The microbeads of polymer have a size of about 2 microns to about 30 microns, preferably about 5 to about 20 microns, and are present in an amount of about 5% to about 50% by weight based on the weight of continuous phase polymer. The voids occupy up to about 60% by volume of the support, preferably from about 30% to about 60% by volume. Larger beads generate a greater amount of void space upon stretching of the supports, but result in a rougher support surface. The use of smaller beads results in a smoother support surface, but they do not generate as much void volume. To obtain a support with both a high void volume and a smooth surface, a dual layer support may be made. The bulk of such a support comprises a layer made with relatively large beads in order to generate a large void volume, and this layer is coated with a smoothing layer containing relatively small beads or no beads at all.

The matrix polymer contains the generally spherical polymer microbeads which, according to one aspect of the invention, are cross-linked to the extent of having a resiliency or elasticity at orientation temperatures of the matrix polymer such that a generally spherical shape of the cross-linked polymer is maintained after orientation of the matrix polymer. The supports according to this invention in the absence of additives or colorants are very white, and are very resistant to wear, moisture, oil, tearing, etc.

The supports are preferably in the form of a paper like sheet having a thickness of about 50 to about 300 microns. Preferably, the supports are made by biaxial orientation using procedures well known in the art.

The continuous phase polymer may be any article-forming polymer such as a polyester capable of being cast into a film or sheet. The polyesters should have a glass transition temperature between about 50° C. and about 150° C., preferably about 60°-100° C., should be orientable, and have an intrinsic viscosity of at least 0.5, preferably 0.6 to 0.9. Suitable polyesters include those produced from aromatic, aliphatic or cyclo-aliphatic dicarboxylic acids of 4-20 carbon atoms and aliphatic or alicyclic glycols having from 2-24 carbon atoms. Examples of suitable dicarboxylic acids include terephthalic, isophthalic, phthalic, naphthalene dicarboxylic acid, succinic, glutaric, adipic, azelaic, sebacic, fumaric, maleic, itaconic, 1,4-cyclohexane-dicarboxylic, sodiosulfoisophthalic and mixtures thereof. Examples of suitable glycols include ethylene glycol, propylene glycol, butanediol, pentanediol, hexanediol, 1,4-cyclohexanedimethanol, diethylene glycol, other polyethylene glycols and mixtures thereof. Such polyesters are well known in the art and may be produced by well-known techniques, e.g., those described in U.S. Pat. Nos. 2,465,319 and 2,901,466. Preferred continuous matrix polymers are those having repeat units from terephthalic acid or naphthalene dicarboxylic acid and at least one glycol selected from ethylene glycol, 1,4-butanediol and 1,4-cyclohexanedimethanol. Poly(ethylene terephthalate), which may be modified by small amounts of other monomers, is especially preferred. Polypropylene is also useful. Other suitable polyesters include liquid crystal copolyesters formed by the inclusion of a suitable amount of a co-acid component such as stilbene dicarboxylic acid. Examples of such liquid crystal copolyesters are those disclosed in U.S. Pat. Nos. 4,420,607, 4,459,402 and 4,468,510.

Suitable cross-linked polymers for the microbeads are polymerizable organic materials which are members selected from the group consisting of an alkenyl aromatic compound having the general formula

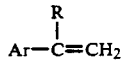

wherein Ar represents an aromatic hydrocarbon radical, or an aromatic halohydrocarbon radical of the benzene series and R is hydrogen or the methyl radical; acrylate-type monomers including monomers of the formula

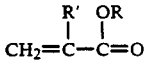

wherein R is selected from the group consisting of hydrogen and an alkyl radical containing from about 1 to 12 carbon atoms and R' is selected from the group consisting of hydrogen and methyl; copolymers of vinyl chloride and vinylidene chloride, acrylonitrile and vinyl chloride, vinyl bromide, vinyl esters having the formula

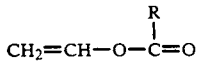

wherein R is an alkyl radical containing from 2 to 18 carbon atoms; acrylic acid, methacrylic acid, itaconic acid, citraconic acid, maleic acid, fumaric acid, oleic acid, vinylbenzoic acid; the synthetic polyester resins which are prepared by reacting terephthalic acid and dialkyl terephthalics or ester-forming derivatives thereof, with a glycol of the series $HO(CH_2)_nOH$, wherein n is a whole number within the range of 2-10 and having reactive olefinic linkages within the polymer molecule, the hereinabove described polyesters which include copolymerized therein up to 20 percent by weight of a second acid or ester thereof having reactive olefinic unsaturation and mixtures thereof, and a cross-linking agent selected from the group consisting of divinylbenzene, diethylene glycol dimethacrylate, diallyl fumarate, diallyl phthalate and mixtures thereof.

Examples of typical monomers for making the cross-linked polymer include styrene, butyl acrylate, acrylamide, acrylonitrile, methyl methacrylate, ethylene glycol dimethacrylate, vinyl pyridine, vinyl acetate, methyl acrylate, vinylbenzyl chloride, vinylidene chloride, acrylic acid, divinylbenzene, arylamidomethylpropane sulfonic acid, vinyl toluene, etc. Preferably, the cross-linked polymer is polystyrene or poly(methyl methacrylate). Most preferably, it is polystyrene and the cross-linking agent is divinylbenzene.

Processes well known in the art yield non-uniformly sized particles, characterized by broad particle size distributions. The resulting beads can be classified by screening to produce beads spanning the range of the original distribution of sizes. Other processes such as suspension polymerization, limited coalescence, directly yield very uniformly sized particles. Suitable slip agents or lubricants include colloidal silica, colloidal alumina, and metal oxides such as tin oxide and aluminum oxide. The preferred slip agents are colloidal silica and alumina, most preferably, silica. The cross-linked polymer having a coating of slip agent may be prepared by procedures well known in the art. For example, conventional suspension polymerization processes wherein the slip agent is added to the suspension is preferred. As the slip agent, colloidal silica is preferred.

It is preferred to use the "limited coalescance" technique for producing the coated, cross-linked polymer microbeads. This process is described in detail in U.S. Pat. No. 3,615,972, incorporated herein by reference. Preparation of the coated microbeads for use in the present invention does not utilize a blowing agent as described in this patent, however.

The following is an example illustrating a procedure for preparing the cross-linked polymeric microbeads coated with slip agent. In this example, the polymer is polystyrene cross-linked with divinylbenzene. The microbeads have a coating of silica. The microbeads are prepared by a procedure in which monomer droplets containing an initiator are sized and heated to give solid polymer spheres of the same size as the monomer droplets. A water phase is prepared by combining 7 liters of distilled water, 1.5 g potassium dichromate (polymerization inhibitor for the aqueous phase), 250 g polymethylaminoethanol adipate (promoter), and 350 g LUDOX® (a colloidal suspension containing 50% silica sold by DuPont). A monomer phase is prepared by combining 3317 g styrene, 1421 g divinylbenzene (55% active crosslinking agent, the other 45% is ethyl vinyl benzene which forms part of the styrene polymer chain) and 45 g VAZO 52® (a monomer-soluble initiator sold by DuPont). The mixture is passed through a homogenizer to obtain 5 micron droplets. The suspension is heated overnight at 52° C. to give 4.3 kg of generally spherical microbeads having an average diameter of about 5 microns with narrow size distribution (about 2–10 microns size distribution). The mol proportion of styrene and ethyl vinyl benzene to divinylbenzene is about 6.1%. The concentration of divinylbenzene can be adjusted up or down to result in about 2.5–50% (preferably 10–40%) crosslinking by the active crosslinker. Of course, monomers other than styrene and divinylbenzene can be used in similar suspension polymerization processes known in the art. Also, other initiators and promoters may be used as known in the art. Also, slip agents other than silica may also be used. For example, a number of LUDOX® colloidal silicas are available from DuPont. LEPANDIN® colloidal alumina is available from Degussa. NALCOAG® colloidal silicas are available from Nalco and tin oxide and titanium oxide are also available from Nalco. Normally, for the polymer to have suitable physical properties such as resiliency, the polymer is crosslinked. In the case of styrene crosslinked with divinylbenzene, the polymer is about 2.5–50% cross-linked, preferably about 20–40% cross-linked. By percent cross-linked, it is meant the mol % of crosslinking agent based on the amount of primary monomer. Such limited crosslinking produces microbeads which are sufficiently coherent to remain intact during orientation of the continuous polymer. Beads of such crosslinking are also resilient, so that when they are deformed (flattened) during orientation by pressure from the matrix polymer on opposite sides of the microbeads, they subsequently resume their normal spherical shape to produce the largest possible voids around the microbeads to thereby produce articles with less density.

The microbeads are referred to herein as having a coating of a "slip agent". By this term it is meant that the friction at the surface of the microbeads is greatly reduced. Actually, it is believed this is caused by the silica acting as miniature ball bearings at the surface. Slip agent may be formed on the surface of the microbeads during their formation by including it in the suspension polymerization mix.

Microbead size is regulated by the ratio of silica to monomer. For example, the following ratios produce the indicated size microbead:

| Microbead Size, Microns | Monomer, Parts by Wt. | Slip Agent (Silica) Parts by Wt. |
|---|---|---|
| 2 | 10.4 | 1 |
| 5 | 27.0 | 1 |
| 20 | 42.4 | 1 |

The supports according to this invention are prepared by:

(a) forming a mixture of molten continuous matrix polymer and cross-linked polymer wherein the cross-linked polymer is a multiplicity of microbeads uniformly dispersed throughout the matrix polymer, the matrix polymer being as described hereinbefore, the cross-linked polymer microbeads being as described hereinbefore, (b) forming a shaped article from the mixture by extrusion, casting or molding, (c) orienting the article by stretching to form microbeads of cross-linked polymer uniformly distributed throughout the article and voids at least partially bordering the microbeads on sides thereof in the direction, or directions of orientation.

The mixture may be formed by forming a melt of the matrix polymer and mixing therein the cross-linked polymer. The cross-linked polymer may be in the form of solid or semi-solid microbeads. Due to the incompatibility between the matrix polymer and cross-linked polymer, there is no attraction or adhesion between them, and they become uniformly dispersed in the matrix polymer upon mixing.

When the microbeads have become uniformly dispersed in the matrix polymer, a shaped article is formed by processes such as extrusion, casting or molding. Examples of extrusion or casting would be extruding or casting a film or sheet, and an example of molding would be injection or reheat blow-molding a bottle. Such forming methods are well known in the art. If sheets or film material are cast or extruded, it is important that such article be oriented by stretching, at least in one direction. Methods of unilaterally or bilaterally orienting sheet or film material are well known in the art. Basically, such methods comprise stretching the sheet or film at least in the machine or longitudinal direction after it is cast or extruded an amount of about 1.5–10 times its original dimension. Such sheet or film may also be stretched in the transverse or cross-machine direction by apparatus and methods well known in the art, in amounts of generally 1.5–10 (usually 3–4 for polyesters and 6–10 for polypropylene) times the original dimension. Such apparatus and methods are well known in the art and are described in such U.S. Pat. No. 3,903,234, incorporated herein by reference.

The voids, or void spaces, referred to herein surrounding the microbeads are formed as the continuous matrix polymer is stretched at a temperature above the Tg of the matrix polymer. The microbeads of cross-linked polymer are relatively hard compared to the continuous matrix polymer. Also, due to the incompatibility and immiscibility between the microbead and the matrix polymer, the continuous matrix polymer slides over the microbeads as it is stretched, causing voids to be formed at the sides in the direction or directions of stretch, which voids elongate as the matrix polymer continues to be stretched. Thus, the final size and shape of the voids depends on the direction(s) and amount of stretching. If stretching is only in one direction, microvoids will form at the sides of the microbeads in the direction of stretching. If stretching is in two directions (bidirectional stretching), in effect such stretching has vector components extending radially from any given position to result in a doughnut-shaped void surrounding each microbead.

The dye image-receiving layer of the receiving elements of the invention may comprise, for example, a polycarbonate, a polyurethane, a polyester, polyvinyl chloride, poly(styrene-co-acrylonitrile), poly(caprolactone) or mixtures thereof. The dye image-receiving layer may be present in any amount which is effective for the intended purpose. In general, good results have been obtained at a concentration of from about 1 to about 5 g/m$^2$. In a preferred embodiment of the invention, the dye image-receiving layer is a polycarbonate. The term "polycarbonate" as used herein means a polyester of carbonic acid and a glycol or a dihydric phenol. Examples of such glycols or dihydric phenols are p-xylylene glycol, 2,2-bis(4-oxyphenyl)propane, bis(4-oxyphenyl)methane, 1,1-bis(4-oxyphenyl)ethane, 1,1-bis(oxyphenyl)butane, 1,1-bis(oxyphenyl)cyclohexane, 2,2-bis(oxyphenyl)butane, etc. In a particularly preferred embodiment, a bisphenol-A polycarbonate having a number average molecular weight of at least about 25,000 is used. Examples of preferred polycarbonates include General Electric LEXAN® Polycarbonate Resin and Bayer AG MACROLON 5700®.

A dye-donor element that is used with the dye-receiving element of the invention comprises a support having theron a dye containing layer. Any dye can be used in the dye-donor employed in the invention provided it is transferable to the dye-receiving layer by the action of heat. Especially good results have been obtained with sublimable dyes such as anthraquinone dyes, e.g., Sumikalon Violet RS® (product of Sumitomo Chemical Co., Ltd.), Dianix Fast Violet 3RFS® (product of Mitsubishi Chemical Industries, Ltd.), and Kayalon Polyol Brilliant Blue N-BGM® and KST Black 146® (products of Nippon Kayaku Co., Ltd.); azo dyes such as Kayalon Polyol Brilliant Blue BM®, Kayalon Polyol Dark Blue 2BM®, and KST Black KR® (products of Nippon Kayaku Co., Ltd.), Sumickaron Diazo Black 5G® (product of Sumitomo Chemical Co., Ltd.), and Miktazol Black 5GH® (product of Mitsui Toatsu Chemicals, Inc.); direct dyes such as Direct Dark Green B® (product of Mitsubishi Chemical Industries, Ltd.) and Direct Brown M® and Direct Fast Black D® (products of Nippon Kayaku Co. Ltd.); acid dyes such as Kayanol Milling Cyanine 5R® (product of Nippon Kayaku Co. Ltd.); basic dyes such as Sumicacryl Blue 6G® (product of Sumitomo Chemical Co., Ltd.), and Aizen Malachite Green® (product of Hodogaya Chemical Co., Ltd.);

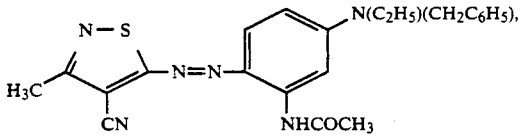

(magenta)

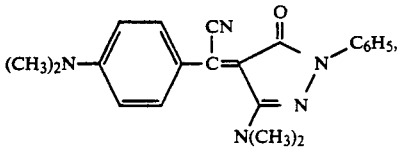

(magenta)

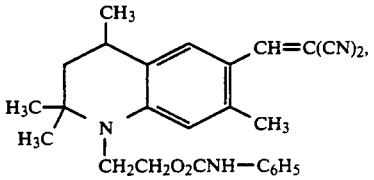

(yellow)

-continued

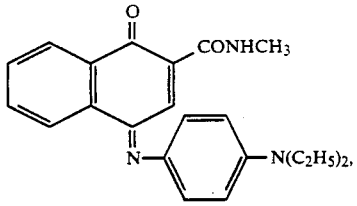

(cyan)

or any of the dyes disclosed in U.S. Pat. No. 4,541,830, the disclosure of which is hereby incorporated by reference. The above dyes may be employed singly or in combination to obtain a monochrome. The dyes may be used at a coverage of from about 0.05 to about 1 g/m$^2$ and are preferably hydrophobic.

The dye in the dye-donor element is dispersed in a polymeric binder such as a cellulose derivative, e.g., cellulose acetate hydrogenphthatate, cellulose acetate, cellulose acetate propionate, cellulose acetate butyrate, cellulose triacetate; a polycarbonate; poly(styrene-co-acrylonitrile), a poly(sulfone) or a poly(phenylene oxide). The binder may be used at a coverage of from about 0.1 to about 5 g/m$^2$.

The dye layer of the dye-donor element may be coated on the support or printed thereon by a printing technique such as a gravure process.

The reverse side of the dye-donor element can be coated with a slipping layer to prevent the printing head from sticking to the dye-donor element. Such a slipping layer would comprise a lubricating material such as a surface active agent, a liquid lubricant, a solid lubricant or mixtures thereof, with or without a polymeric binder. Preferred lubricating materials include oils or semi-crystalline organic solids that melt below 100° C. such as poly(vinyl stearate), beeswax, perfluorinated alkyl ester polyethers, poly(caprolactone), carbowax or poly(ethylene glycols). Suitable polymeric binders for the slipping layer include poly(vinyl alcohol-co-butyral), poly(vinyl alcohol-co-acetal), poly(styrene), poly(vinyl acetate), cellulose acetate butyrate, cellulose acetate, or ethyl cellulose.

The amount of the lubricating material to be used in the slipping layer depends largely on the type of lubricating material, but is generally in the range of from about 0.001 to about 2 g/m$^2$. If a polymeric binder is employed, the lubricating material is present in the range of 0.1 to 50 weight %, preferable 0.5 to 40, of the polymeric binder employed.

As noted above, the dye-donor elements and receiving elements of the invention are used to form a dye transfer image. Such a process comprises imagewise-heating a dye-donor element as described above and transferring a dye image to a dye-receiving element to form the dye transfer image.

The dye-donor element may be used in sheet form or in a continuous roll or ribbon. If a continuous roll or ribbon is employed, it may have only one dye thereon or may have alternating areas of different dyes, such as sublimable cyan, magenta, yellow, black, etc., as described in U.S. Pat. No. 4,541,830. Thus, one-, two-three- or four-color elements (or higher numbers also) are included within the scope of the invention.

In a preferred embodiment, the dye-donor element comprises a poly(ethylene terephthalate) support coated with sequential repeating areas of cyan, magenta and yellow dye, and the above process steps are sequentially performed for each color to obtain a three-color dye transfer image. Of course, when the process is only performed for a single color, then a monochrome dye transfer image is obtained.

Thermal printing heads which can be used to transfer dye from the dye-donor elements to the receiving elements are available commercially. There can be employed, for example, a Fujitsu Thermal Head (FTP-040 MCS001), a TDK Thermal Head F415 HH7-1089 or a Rohm Thermal Head KE 2008-F3.

A thermal dye transfer assemblage of the invention comprises:

a) a dye-donor element as described above, and b) a dye-receiving element as described above, the dye-receiving element being in a superposed relationship with the dye-donor element so that the dye layer of the donor element is in contact with the dye image-receiving layer of the receiving element.

The above assemblage comprising these two elements may be preassembled as an integral unit when a monochrome image is to be obtained. This may be done by temporarily adhering the two elements together at their margins. After transfer, the dye-receiving element is then peeled apart to reveal the dye transfer image.

When a three-color image is to be obtained, the above assemblage is formed on three occasions during the time when heat is applied by the thermal printing head. After the first dye is transferred, the elements are peeled apart. A second dye-donor element (or another area of the donor element with a different dye area) is then brought in register with the dye-receiving element and the process repeated. The third color is obtained in the same manner.

The following examples are provided to illustrate the invention.

Preparation of Microvoided Supports

A Welders Engineering Twin Screw Compounding Extruder heated to 282° C. was used to mix polystyrene microbeads (sizes, crosslinking %, and slip agent coatings as indicated in the table below) and poly(ethylene terephthalate)("PET", commercially available as #7352 from Eastman Chemicals). Both components were metered into the compounder and one pass was sufficient for dispersion of the beads into the PET matrix.

Cast sheets of the above bead/PET dispersion with a poly(ethylene terephthalate) smoothing layer were coextruded using a Killion Sample Coextruder System (a 1.5 inch Killion Extruder was used to produce the bead/PET melt stream, and a 1 inch Killion Extruder was used for the PET smoothing layer meltstream). The two meltstreams at 282° C. were fed into a 7 inch "coat-hanger" type single manifold die also heated at 282° C. As the coextruded sheet emerged from the die, it was cast onto a quenching roll set at 55°C. The final dimensions of the continuous cast sheet were 18 cm wide and 1270 microns thick. The bead/PET layer was 1016 microns thick and the PET smoothing layer was 254 microns thick.

The cast sheets (18 cm×18 cm) were then stretched at 110° C. and 50 mm/sec using an Iwamoto Seisakusho Co. LTD Model BIX7025 Sample stretcher first 3.75 times in the X-direction and then 3.5 times in the Y-direction. The stretched sheets were annealed at 117°-122° C. for 90 sec and were allowed to cool at room temperature, and were then removed from the stretcher.

The following microvoided supports each with the indicated composite densities were produced. Each support had the same PET smoothing layer of approximately 20 microns thickness after stretching.

| | Wt. % Beads | % Cross-linking | Slip Agent Coating | Bead Size, Microns |
|---|---|---|---|---|
| E-1 | 17 | 30 | Silica | 2 |
| E-2 | 20 | 5 | Alumina | 2 |
| E-3 | 5 | 30 | Silica | 5 |
| E-4 | 20 | 30 | Silica | 10 |
| E-5 | 25 | 30 | Silica | 10 |

| | Support Thickness (Microns) | Support Density ($g/cm^3$) | Approx. Void % (Voided layer) |
|---|---|---|---|
| E-1 | 144 | 1.03 | 25 |
| E-2 | 158 | 1.01 | 27 |
| E-3 | 177 | 0.84 | 43 |
| E-4 | 230 | 0.67 | 54 |
| E-5 | 297 | 0.59 | 59 |

The void percentages were calculated using approximate densities of 1.4 $g/cm^3$ for PET and 1 $g/cm^3$ for polystyrene.

Three control supports were also evaluated:

C-1 Eastman Radiographic Intensifying Screen (A non-microvoided support of poly(ethylene terephthalate) of 180 microns thickness, 1.41 $g/cm^3$ density, containing approximately 8% titanium dioxide.)

C-2 ICI Corp. MELINEX 571 ®

(A non-microvoided support of poly(ethylene terephthalate) of 180 microns thickness, 1.35 $g/cm^3$ density, containing approximately 18% barium sulfate.)

C-3 Oji Yuka Goseishi YUPO FPG150 ®

(A microvoided support of polypropylene of 150 microns thickness, 0.78 $g/cm^3$ density, containing calcium carbonate.)

Preparation of Dye-Receiving Elements

The smooth side of the microvoided supports were first coated with a subbing layer of poly(acrylonitrile-co-vinylidene chloride-co-acrylic acid) (14:80:6 wt. ratio) (0.11 $g/m^2$) from butanone. On top of this layer, a dye receiving layer of Bayer AG MAKROLON 5700 ® (a bis-phenol A polycarbonate) (2.9 $g/m^2$), 3M Corp. FLUORAD FC-431 ® (a fluorinated surfactant) (0.02 $g/m^2$), and Dow Corning DC-510 ® Silicone Fluid (0.01 $g/m^2$) was coated from dichloromethane. Each control support was coated with the same dye-receiving layer.

Preparation of Dye-Donor Elements

Cyan dye-donor elements were prepared by coating the following layers in the order recited on a 6 μm poly(ethylene terephthalate) support:

1) A subbing layer of duPont TYZOR TBT ® titanium tetra-n-butoxide (0.12 $g/m^2$) from 1-butanol; and 2) A layer containing the cyan dye

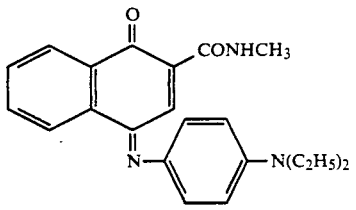

(0.42 g/m²)

and Shamrock Tech. S-363 ® (a micronized blend of hydrocarbon wax particles) (0.016 g/m²) in a cellulose acetate butyrate (17% acetyl and 28% butyryl) binder (0.66 g/m²) coated from a cyclopentanone, toluene and methanol solvent mixture.

Magenta dye-donor elements were prepared by coating the following layers in the order recited on a 6 μm poly(ethylene terephthalate) support:

1) A subbing layer of duPont TYZOR TBT ® (0.12 g/m²) from 1-butanol; and
2) A layer containing the magenta dyes

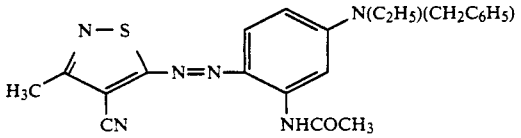

(0.12 g/m²)

and

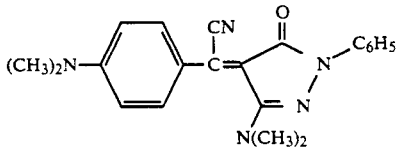

(0.13 g/m²)

and Shamrock Tech. S-363 ® (a micronized blend of hydrocarbon wax particles) (0.016 g/m²) in a cellulose acetate butyrate (17% acetyl and 28% butyryl) binder (0.40 g/m²) coated from a cyclopentanone, toluene and methanol solvent mixture.

On the back sides of the cyan and magenta dye-donor elements was coated:

1) A subbing layer of duPont TYZOR TBT ® (0.12 g/m²) from 1-butanol; and
2) A slipping layer of Acheson Colloids EMRALON 329 ® polytetrafluoroethylene dry film lubricant (0.59 g/m²), Petrarch Systems PS-513 ® (an amino terminated polydimethyl siloxane) (0.005 g/m²), BYK-Chemie BYK-320 ® (a polyoxyalkylene siloxane) (0.005 g/m²), and Shamrock Tech. S-232 ® (a micronized blend of polyethylene and carnauba wax particles) (0.016 g/m²) coated from a n-propyl acetate, toluene, 2-propanol, and 1-butanol solvent mixture.

Evaluation of Dye-Transfer

The dye layer sides of cyan and magenta donor element strips of approximately 9 cm × 12 cm in area were placed in contact with the image-receiving layer of receiving elements of the same area. Each assemblage was fastened in the jaws of a stepper motor driven pulling device, and laid on top of a 14 mm diameter rubber roller. A TDK Thermal Head L-133 (No. 6-2R16-1) was pressed with a spring at a force of 3.6 kg against the donor element side of the contacted pair pushing it against the rubber roller.

The imaging electronics were activated causing the pulling device to draw the assemblage between the printing head and roller at 3.1 mm/sec. Coincidentally the resistive elements in the thermal print head were pulsed at a per pixel pulse width of 8 msec to generate a maximum density image. The voltage supplied to the print-head was approximately 25 V representing approximately 1.6 watts/dot (13. mjoules/dot).

After printing the dye images to maximum density, the receivers were separated from the donors. The Status A Green transmission density of the magenta donors and the Status A Red transmission density of the cyan donors were measured both before and after dye transfer. The greater the change in transmission density, the greater the amount of dye transferred to the receiver, demonstrating greater thermal efficiency.

| | Magenta Donor Density | | | Cyan Donor Density | | |
|---|---|---|---|---|---|---|
| Support | Initial | After Transfer | Change | Initial | After Transfer | Change |
| C-1 | 1.7 | 1.1 | 0.6 | 2.0 | 1.4 | 0.6 |
| C-2 | 1.7 | 0.9 | 0.8 | 2.0 | 1.2 | 0.8 |
| C-3 | 1.7 | 0.7 | 1.0 | 2.0 | 1.0 | 1.0 |
| E-1 | 1.7 | 0.7 | 1.0 | 2.0 | 0.8 | 1.2 |
| E-2 | 1.7 | 0.7 | 1.0 | 2.0 | 0.9 | 1.1 |
| E-3 | 1.7 | 0.6 | 1.1 | 2.0 | 0.7 | 1.3 |
| E-4 | 1.7 | 0.6 | 1.1 | 2.0 | 0.6 | 1.4 |
| E-5 | 1.7 | 0.6 | 1.1 | 2.0 | 0.6 | 1.4 |

The above data demonstrates that the use of the thermal dye transfer receiving elements of the invention results in improved transfer efficiency as a greater amount of dye is transferred from dye donor elements used with such receiving elements.

The invention has been described in detail with particular reference to preferred embodiments thereof, but it will be understood that variations and modifications can be effected within the spirit and scope of the invention.

What is claimed is:

1. In a dye-receiving element for thermal dye transfer comprising a support having thereon a dye image-receiving layer, the improvement wherein said support comprises a continuous oriented polymer matrix phase having dispersed therein microbeads of a crosslinked polymer coated with a slip agent and which are at least partially bordered by void space.

2. The dye-receiving element of claim 1 wherein the average size of said microbeads is from about 2 microns to about 30 microns.

3. The dye-receiving element of claim 1 wherein the continuous oriented polymer matrix phase comprises a polyester.

4. The dye-receiving element of claim 3 wherein the polyester is poly(ethylene terephthalate).

5. The dye-receiving element of claim 1 wherein the support comprises from about 30 to about 60 volume percent void space.

6. The dye-receiving element of claim 1, further comprising a smoothing layer between the void containing support and the dye image-receiving layer.

7. The dye-receiving element of claim 6 wherein the smoothing layer contains microbeads of a relatively smaller size than the beads in the void containing support.

8. In a process of forming a dye transfer image comprising:

a) imagewise-heating a dye-donor element comprising a support having thereon a dye layer comprising a dye dispersed in a binder, and b) transferring a dye image to a dye-receiving element comprising a support having thereon a dye image-receiving layer to form said dye transfer image, the improvement wherein said dye-receiving element support comprises a continuous oriented polymer matrix phase having dispersed therein microbeads of a cross-linked polymer coated with a slip agent and which are at least partially bordered by void space.

9. The process of claim 8 wherein the average size of said microbeads is from about 2 microns to about 30 microns.

10. The process of claim 8 wherein the oriented polymer matrix phase comprises poly(ethylene terephthalate).

11. The process of claim 8 wherein the dye-receiving element support comprises from about 30 to about 60 volume percent void space.

12. The process of claim 8 wherein said support is coated with sequential repeating areas of cyan, magenta and yellow dye, and said process steps are sequentially each color to obtain a three-color dye transfer image.

13. In a thermal dye transfer assemblage comprising:

a) a dye-donor element comprising a support having thereon a dye layer comprising a dye dispersed in a binder, and b) a dye-receiving element comprising a support having thereon a dye image-receiving layer, said dye-receiving element being in a superposed relationship with said dye-donor element so that said dye layer is in contact with said dye image-receiving layer, the improvement wherein the dye-receiving element support comprises a continuous oriented polymer matrix phase having dispersed therein microbeads of a cross-linked polymer coated with a slip agent and which are at least partially bordered by void space.

14. The assemblage of claim 13 wherein the average size of said microbeads is from about 2 microns to about 30 microns.

15. The assemblage of claim 13 wherein the oriented polymer matrix phase comprises poly(ethylene terephthalate).

16. The assemblage of claim 13 wherein the dye-receiving element support comprises from about 30 to about 60 volume percent void space.

17. The assemblage of claim 13 wherein said dye layer comprises sequential repeating areas of cyan, magenta and yellow dye.

* * * * *